United States Patent [19]

Siemers et al.

[11] Patent Number: 5,017,438

[45] Date of Patent: May 21, 1991

[54] SILICON CARBIDE FILAMENT REINFORCED TITANIUM ALUMINIDE MATRIX WITH REDUCED CRACKING TENDENCY

[75] Inventors: Paul A. Siemers, Clifton Park; Ann M. Ritter, Schenectady, both of N.Y.

[73] Assignee: General Electric Company, Schenectady, N.Y.

[21] Appl. No.: 455,041

[22] Filed: Dec. 22, 1989

[51] Int. Cl.[5] ..... C22C 1/09; C22C 14/00

[52] U.S. Cl. ..... 428/614; 427/34

[58] Field of Search ..... 428/614; 427/34

[56] References Cited

FOREIGN PATENT DOCUMENTS 1185349 3/1970 United Kingdom .
1327171 8/1973 United Kingdom .
2219006 11/1989 United Kingdom .

OTHER PUBLICATIONS

Brewer et al., "Metallurgical and Tensil Property Analysis of Several Silicon Carbide/Titanium . . . ", Metals Abs. 84-620054 and 82-630400.

*Primary Examiner*—Theodore Morris
*Assistant Examiner*—David W. Schumaker
*Attorney, Agent, or Firm*—Paul E. Rochford; James C. Davis, Jr.; James Magee, Jr.

[57] ABSTRACT

A method for forming a composite having a matrix which is stronger and which is resistant to cracking is disclosed. The composite is reinforced by silicon carbide fibers. The silicon carbide fibers are first RF plasma-spray coated with a niobium metal and the matrix metal of titanium base alpha-2 crystal structure is next RF plasma-spray deposited over the niobium coated SiC fibers to form a layer of Ti base metal reinforced by SiC fibers. A plurality of layered structures are consolidated by heat and pressure into a composite structure.

9 Claims, 2 Drawing Sheets

SILICON CARBIDE FILAMENT REINFORCED TITANIUM ALUMINIDE MATRIX WITH REDUCED CRACKING TENDENCY

CROSS-REFERENCE TO RELATED APPLICATIONS

The subject application relates to copending applications Ser. No. 07/445,203, filed Dec. 4, 1989; Ser. No. 07/455,048, filed Dec. 22, 1989; and Ser. No. 07/459,894, filed Jan. 2, 1990.

BACKGROUND OF THE INVENTION

The present invention relates generally to improving the properties of a silicon carbide reinforced titanium aluminide matrix composite. More particularly, it relates to reducing the tendency of cracks to form in the titanium aluminide matrix.

It is known that filament strengthened composites can be formed by plasma deposition of a matrix material about a reinforcing filament. This teaching and related teachings are contained in the U.S. Pat. Nos. 4,775,547; 4,782,884; 4,786,566; 4,805,294; 4,805,833; and 4,838,337. The inventor of these prior art patents is one of the inventors herein and the prior art patents are assigned to the same assignee as the subject invention.

As pointed out in these earlier patents, it is known that silicon carbide fibers can be formed with great strength and with high temperature tolerance. It is also known that titanium foils have been used in connection with SiC fibers to produce SiC reinforced composites in which the SiC fibers are embedded in a sheet of titanium alloy made up of a number of layers of foil. The above-referenced patents are directed toward improvements over this conventional practice for forming silicon carbide reinforced matrices.

Employing the technique of the above-referenced patents, composites can be fabricated using several techniques pointed out in the patents to spray deposit any one of a variety of titanium base alloys on the silicon carbide reinforcing filaments. A preferred alloy for fabrication of such composites is a titanium base alloy containing 14 weight percent aluminum and 21 weight percent niobium. The alloy is known conventionally as Ti-1421. The matrix of the composite formed from such an alloy consists primarily of alpha-2, an ordered intermetallic phase with small amounts of beta-phase. The alpha-2 tends to have low ductility and envelopes of this phase around the SiC fiber have been found to crack during consolidation and also during subsequent thermal exposure. Radial cracks in the alpha-2 envelope propagate into the surrounding matrix when the material is loaded in tension. Such radial cracks may affect the overall mechanical properties by leading to premature composite fracture, and particularly lateral cracking and fracture.

BRIEF STATEMENT OF THE INVENTION

It is, accordingly, one object of the present invention to provide a method by which the tendency of matrices of titanium base alloys which are reinforced by silicon carbide filaments may resist cracking.

Another object is to provide a silicon carbide reinforced titanium base composite in which there is a reduced tendency for crack formation in the matrix of the composite.

Another object is to provide a means by which the cracking of matrices of titanium base alloys reinforced by silicon carbide filaments may be improved.

Other objects will be in part apparent and in part pointed out in the description which follows.

In one of its broader aspects, objects of the present invention can be achieved by providing a set of SiC filaments for reinforcing a titanium base alloy matrix which solidifies into an alpha-2 crystal form, plasma-spray coating said filaments with a layer of a beta-phase stabilizer, such as niobium, in a quantity adapted to convert at least part of the alpha-2 crystal form to beta-phase, transformed beta-phase, or ordered beta-phase, and plasma-spray depositing said titanium base alloy matrix on said plasma coated filaments.

BRIEF DESCRIPTION OF THE DRAWINGS

The description which follows will be understood with greater clarity if reference if made to the accompanying drawing in which.

DETAILED DESCRIPTION OF THE INVENTION

Figure 1:
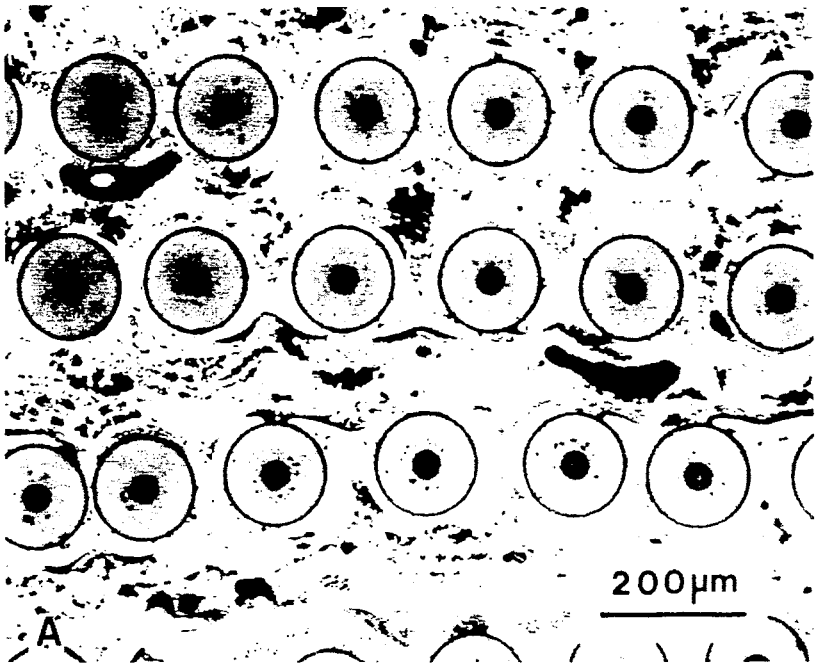
FIG. 1 is a photomicrograph depicting silicon carbide filaments bearing a surface coating of niobium metal embedded in a matrix of a titanium aluminide.

As noted above, the plasma-spray deposition and hot isostactic pressing (HIP) densification of the alloy Ti-1421 results in the formation of an essentially continuous alpha-2 envelope around the filaments of the silicon carbide reinforcement. It has been observed that the matrix composed essentially of alpha-2 microstructure results in the development of radial cracks in the alpha-2 envelope and that these cracks propagate into the surrounding matrix when the material is loaded in tension, particularly when the tension is applied laterally, or in other words in a direction normal to the axis of the reinforcing filaments.

To overcome the tendency of crack formation and the resultant alteration in overall mechanical properties, including premature composite fracture, it has been found that it is possible to largely reduce or eliminate such cracking by introducing a much larger proportion of beta-phase or transformed beta-phase into the matrix. To do this the silicon carbide fibers are first plasma-spray coated pursuant to the present invention with a beta-phase stabilizer such as niobium or an alloy of niobium.

This step of coating the silicon carbide fibers with niobium is one which cannot be precisely controlled to deposit only a fine closely dimensioned and uniform layer of niobium onto the surface of the silicon carbide fibers. Rather, the deposit is uneven, both with respect to the nonuniformity of thickness of the deposit which is formed from the plasma-spraying but also from the nonuniform coating of the entire surface of the fibers. Accordingly, some portions of the fibers are found to have a greater thickness of the coating and other portions of the fiber surface are found to be uncoated.

Surprisingly, it has been found, nevertheless, that the plasma-spray deposit of a beta-phase stabilizer, such as niobium, onto the silicon carbide fibers is effective in providing a measure of protection of the portion of the matrix which is contact with the coated fiber from the cracking phenomena which has been observed and which is described and referred to above.

As indicated above, the niobium which is plasma-spray deposited onto the silicon carbide fibers forms a generally uneven surface deposit of niobium onto the fibers. The desired deposit would be a uniform deposit of uniform thickness and uniformly distributed around the fiber as is explained more fully in copending application Ser. No. 07/455,048, filed Dec. 22, 1989, and referenced above under Cross-Reference to Related Applications. However, we have found that it is possible to very significantly improve the properties of the composite of silicon carbide in a titanium base alloy where plasma spray is employed in forming the surface coating of niobium even though the surface coating is not of uniform thickness nor of uniform distribution about the silicon carbide fibers.

The benefit of the beta-phase stabilizer coating, such as the niobium surface coating, is set out more fully in the copending application Ser. No. 07,455,048, filed Dec. 22, 1989. In this copending application, the text of which is incorporated herein by reference, it is brought out that the niobium surface layer is of particular benefit in overcoming the tendency of titanium base alloy matrices to undergo radial cracking in the portions thereof which abut the silicon carbide fiber surface. Such radial cracking is, in turn, deemed to be responsible for a reduction of the lateral strength of the matrix inasmuch as the surface cracks are subject to spreading and leading to a general mechanical failure of the matrix when subjected to lateral tensile force.

The surface coating of niobium serves as a beta-phase stabilizer and results in the formation, in the region of the envelope of the matrix which surrounds the fiber, of a beta-phase crystal form and of an ordered beta-phase crystal structure. The beta-phase crystal form is known to have a far greater ductility than that of the alpha-2 crystal structure. Surprisingly, however, it has been our finding that this enhancement of the ductility of the envelope portion of the matrix surrounding the individual fibers is achievable even though the deposit which is made is not of uniform thickness nor of uniform distribution around the individual fibers.

One of the more significant results of this finding is that it is possible to employ a plasma-spray technique in depositing a surface layer of niobium on the silicon carbide fibers. The use of plasma-spray techniques greatly enhances the processing of the materials used in forming the reinforced matrix inasmuch as the plasma-spray technique delivers a great deal more material in a shorter period of time than other techniques such as chemical vapor deposition or sputtering. Moreover, the matrix of metal which forms the bulk of the matrix of the composite structure is preferably deposited by plasma-spray method for reasons which are explained more fully in the patents which are referred to above. One such reason is that the titanium base matrix when deposited by plasma-spray techniques tends to deposit all around and in between the fibers and in this way to reduce the amount of movement of matrix material which is needed in order to fully consolidate the matrix to full density. These and other reasons are pointed out in the patents which are referred to above.

Figure 2:
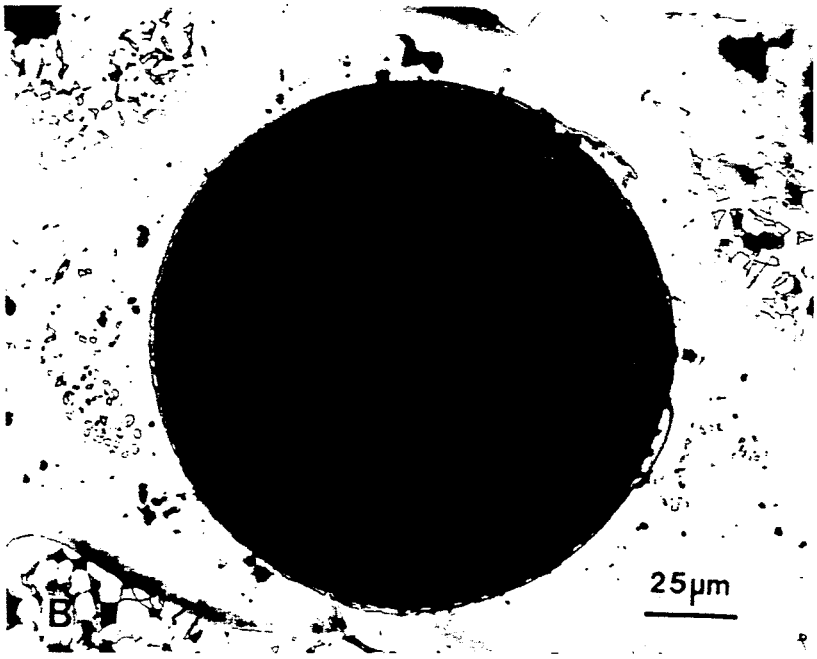
FIG. 2 is a detail of a silicon carbide filament in a matrix and depicting the surface coating of niobium in greater detail.

The nonuniform character of the deposit both with regard to uniformity of thickness and with regard to uniformity of distribution about the fiber is evident from the micrographs of FIGS. 1 and 2 which accompany this specification. While these figures are not totally clear with regard to this factor, nevertheless the contour lines of material proximate the individual fibers in FIG. 1 do depict the niobium deposit contour and it is evident that a substantial nonuniformity of deposit can be made out. However, as indicated above, in spite of this nonuniformity, very striking and desirable improvements in properties are achieved.

The advantage and benefit of the invention may be made clearer by an illustrative example of a method employed in forming the composite structure and of tests performed on the structure which is formed.

EXAMPLES 1–8

A number of strands of silicon carbide fibers were obtained from Textron Specialty Materials Corporation. These fibers are identified as SCS-6 SiC fibers and are obtainable from the Textron Specialty Materials Corporation. The set of fibers were wound on a steel drum and anchored to the drum in a conventional manner. The 128 filaments per inch spacing between adjacent fibers was maintained at a fairly uniform separation so that a portion of the material applied as by spraying would pass through spaces between the fibers. A sample of a niobium powder was obtained from the Cabot Corporation. It was screened and 20 grams of the fraction having −100 to +200 mesh was employed in forming a plasma spray deposited layer of niobium on the first two SiC fibers in Examples 1 and 2.

The plasma-spray deposit was carried out in a standard RF plasma apparatus similar to that described in the above-referenced patents of Siemers. A preferred method of carrying out the plasma-spraying is described in the copending application Ser. No. 07,524,527, filed May 17, 1990. The plasma-spray technique, however, is not a part of the present invention.

The 20 grams of the niobium powder was RF plasma-spray deposited on each of two of several sets of SCS-6 fibers mounted on the steel drum using conventional plasma spraying parameters. The gas employed in the RF plasma spray deposit of the niobium contained about 3% hydrogen.

Following the deposit of the niobium coating onto the fibers of Examples 1 and 2, a RF plasma-spray deposit of matrix metal was made. The matrix metal was an alloy containing 15 weight % aluminum and 21 weight % of niobium in a titanium base. This alloy is known commercially as Ti1421. The percentage of aluminum and niobium additives may vary by a few percent from the values of 14 for aluminum and 21 for niobium indicated by the alloy designation as Ti-1421. It is known that the Ti-1421 has a strong tendency to form the alpha-2 crystal form, and, as has been noted above, it has been observed that there is a tendency toward formation of transverse cracks in the alpha-2 phase which is present in the envelope surrounding the SiC fibers in a composite structure. The RF plasma-spray deposit of the Ti-1421 matrix results in formation of a foil-like or tape-like deposit containing the SiC reinforcement.

The Ti-1421 powder employed in this plasma-deposition of the Ti-1421 matrix is a fraction having a sieve size of −80+140 and a corresponding particle size of 105–177 microns. The hydrogen level in the plasma gas, containing $\frac{1}{3}$ argon and $\frac{2}{3}$ helium, was about 3% hydrogen.

Four individual plies of the fiber-reinforced construction were prepared for Examples 1 and 2. The 4-plies were assembled and contained within an evacuated HIPing can. The assembly of the 4 plies was heated to 1,000° C. and HIPed at this temperature for 3 hours at 15,000 psi pressure. The 4-ply composite plate resulting from this operation contained 29 volume % of SiC reinforcing fiber. A microstructure of the HIPed plate of Example 1 is shown in FIG. 1. The unetched regions around the fiber are niobium-rich. The dark etching phase in the matrix is beta-phase or transformed beta-phase and the light regions in the matrix are alpha-2. A fiber of the plate of Example 1 and its surrounding niobium coating are seen in greater detail in FIG. 2.

Examination of the sample showed that there was a niobium-rich region surrounding or partially surrounding the fibers of FIG. 1. There was essentially no continuous alpha-2 envelope. No cracks were seen in the niobium-rich regions of beta-phase or ordered beta-phase adjacent to the fibers in this sample. In the discontinuous alpha-2 regions in contact with the fibers a few instances of cracking were observed. The reaction zone between the fibers and the plasma-sprayed niobium was about 1 μm thick.

In a composite made without the plasma-sprayed niobium coating on the fibers as, for instance, in Examples 6–8, the reaction zone between fiber and matrix was about 2.5 μm thick. Since increasing the reaction zone thickness can have a deleterious effect on mechanical properties, limiting the reaction zone thickness by deposition of a niobium coating and by process control can be important to preserving the mechanical properties.

Tensile samples were made from the composite formed with the aid of the niobium coated fibers as well as from composites made without niobium coated fibers. Tests of these tensile samples were made at room temperature with the applied stress perpendicular to the fiber axis. The data obtained from this testing are listed in Table I.

TABLE I

Room Temperature Transverse Tensile Data for Plasma-Sprayed Ti-1421/SCS-6 Composition

| Ex. | RF No. | Description | U. T. S. | Total Strain |
|---|---|---|---|---|
| 1 | 957 | plasma-sprayed Nb high-beta matrix | 47;46 ksi | 0.32; 0.29% |
| 2 | 1053 | plasma-sprayed Nb high-beta matrix | 44;49 ksi | 0.41; 0.35% |
| 3 | 823 | high-beta matrix | 43 | 0.28 |
| 4 | 971 | high-beta matrix | 42 | 0.30 |
| 5 | 963 | high-beta matrix | 39; 41 | 0.22; 0.24 |
| 6 | 820 | high alpha-2 matrix | 34 | 0.19 |
| 7 | 764 | high alpha-2 matrix | 37 | 0.21 |
| 8 | 960 | high alpha-2 matrix | 31 | 0.21 |

Of the eight specimens listed in Table I, only two, that is the specimen of Examples 1 and 2, RF No. 957 and 1053, were prepared by the method of the present invention as described above. Three of the other six test specimens were prepared to have an optimum matrix with a high beta-phase content but without any coating of niobium on the reinforcing filaments. The other three specimens were prepared to have the conventional high alpha-2 crystal form of matrix.

The high beta matrix of Examples 1–4 was prepared using the method of copending application Ser. No. 07,459,894, filed Jan. 2, 1990, the text of which is incorporated herein by reference. The high alpha-2 matrix specimens of Examples 6–8 were prepared in a conventional manner. It can be seen from the ultimate tensile strength values listed that the high beta samples were generally stronger than the samples containing mostly alpha-2. Further, it can be seen that the high beta samples made using the niobium coated fibers were found to be strongest of all.

Figure 3:
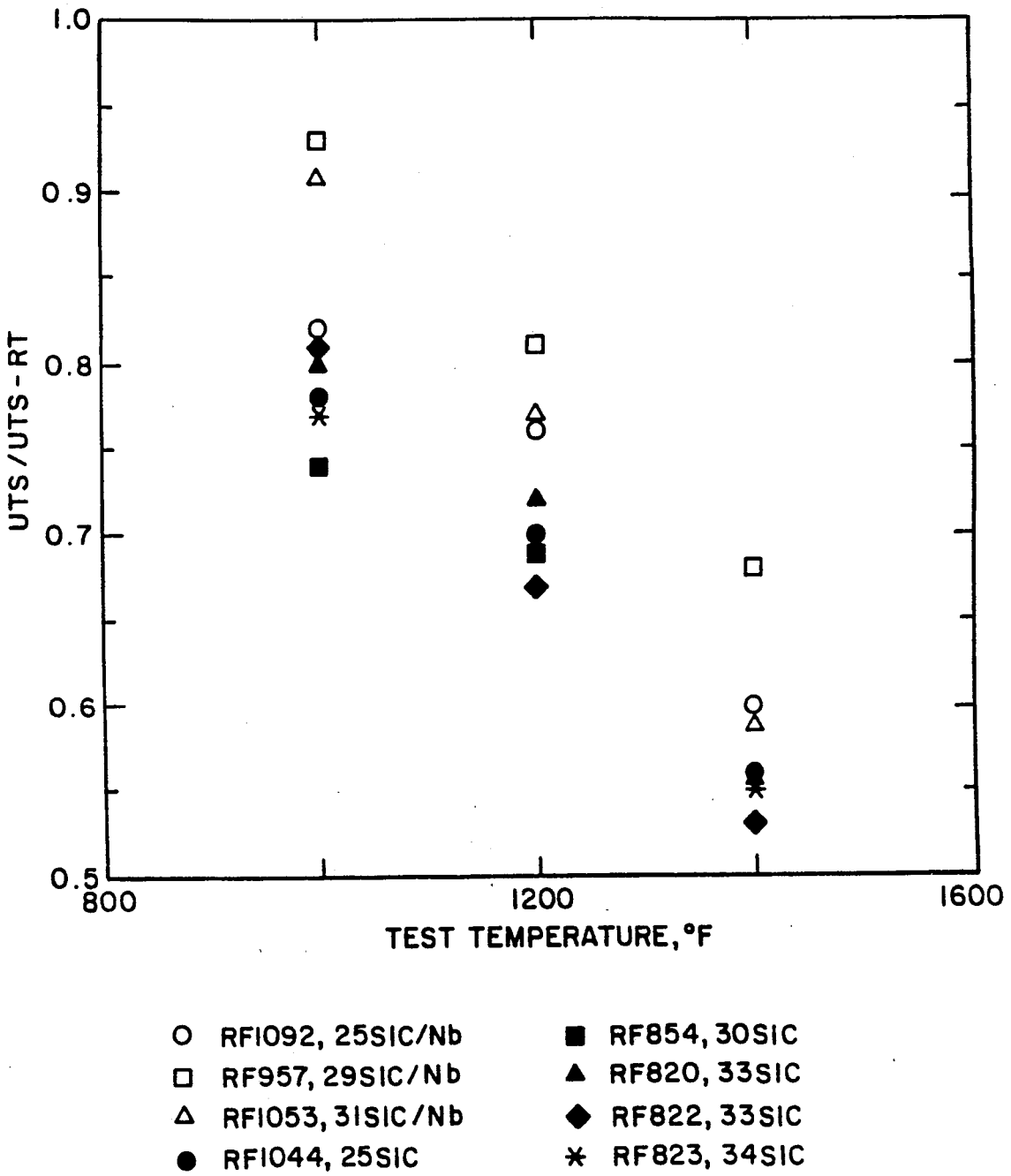
FIG. 3 is a graph in which the ultimate tensile strength (UTS) at elevated temperature is compared to the ultimate tensile strength at room temperature for a set of SiC reinforced titanium base matrix compositions.

Comparative longitudinal tensile data was developed over a range of temperatures and included tests at 1000° F., 1200° F., and 1400° F. The data was normalized and is plotted in FIG. 3. In this Figure, a plot is made for each test temperature of the ratio of the ultimate tensile strength of a specimen at the test temperature to the tensile strength of the same specimen at room temperature. From the graph developed, it is obvious that the three niobium-bearing composite plates had the best tensile properties at all test temperatures.

It was quite surprising to find that this significant improvement in the lateral tensile properties of the composite structure could be achieved although there was no precise control of the thickness or of the distribution of the niobium material plasma-spray deposited onto the fibers. Although the deposit was of uneven distribution on the fibers, the overall result is a net increase in the beneficial properties of the composite structure including the lateral tensile properties of the matrix of the material.

What is claimed is:

1. A reinforced structure which comprises,
a set of reinforcing silicon carbide filaments,
an partial and irregular coating of plasma-spray deposited beta-phase stabilizer metal on the silicon carbide filaments, and
a matrix of a titanium base alloy having an alpha-2 crystal form extending between said coated filaments as a matrix of a composite structure.

2. The structure of claim 1, in which the beta-phase stabilizer is an alloy of niobium which is resistant to oxidation.

3. The structure of claim 1, in which the beta-phase stabilizer is elemental niobium.

4. The structure of claim 1, in which the irregularity of the coating is with respect to uneven thickness and uneven distribution about the filament surface.

5. The structure of claim 1, in which the titanium base metal is Ti-1421.

6. The structure of claim 1, in which the structure is densified by heat and pressure.

7. The structure of claim 1, in which the structure is HIPed to higher density.

8. The structure of claim 1, in which the structure is vacuum hot pressed to densify the matrix thereof.

9. The method of forming a strong composite structure resistant to matrix cracking which comprises,
providing a set of reinforcing silicon carbide filaments,
plasma-spray coating said filaments with an irregular partial and surface layer of a beta-phase stabilizer metal, and
plasma-spray depositing a matrix of a titanium base metal on said set of beta-phase stabilizer coated silicon carbide filaments to form a crack resistant composite structure.

* * * * *